US008556234B2

(12) United States Patent
Hartman et al.

(10) Patent No.: US 8,556,234 B2
(45) **Date of Patent: *Oct. 15, 2013**

(54) SINGLE CABLE DESCENT CONTROL DEVICE

(75) Inventors: Gregory A. Hartman, Drayton Valley (CA); Dan S. Smith, Drayton Valley (CA)

(73) Assignee: RIDE Inc. (CA)

( * ) Notice: Subject to any disclaimer, the term of this patent is extended or adjusted under 35 U.S.C. 154(b) by 902 days.

This patent is subject to a terminal disclaimer.

(21) Appl. No.: 12/617,999

(22) Filed: Nov. 13, 2009

(65) Prior Publication Data

US 2011/0114907 A1 May 19, 2011

(51) Int. Cl.
*B66D 3/04* (2006.01)
*B61B 7/00* (2006.01)

(52) U.S. Cl.
USPC ..... 254/391; 182/10

(58) Field of Classification Search
USPC ..... 254/268, 391; 188/156, 161; 187/350; 182/5, 10, 11, 36, 37, 72, 234, 235
See application file for complete search history.

(56) References Cited

U.S. PATENT DOCUMENTS

| | | | | |
|---|---|---|---|---|
| 3,625,317 | A * | 12/1971 | Baermann | 188/165 |
| 3,946,989 | A * | 3/1976 | Tsuda | 182/241 |
| 4,567,963 | A * | 2/1986 | Sugimoto | 182/236 |
| 4,826,150 | A | 5/1989 | Minoura | |
| 5,477,094 | A | 12/1995 | Lamb | |
| 6,293,376 | B1 * | 9/2001 | Pribonic | 188/165 |
| 7,178,644 | B2 * | 2/2007 | Kloft et al. | 188/161 |
| 2009/0159373 | A1 * | 6/2009 | Hartman et al. | 187/350 |

FOREIGN PATENT DOCUMENTS

CA 2 539 883 A1 8/2007

OTHER PUBLICATIONS

Printout from the Wikipedia web-site located at the URL http://en.wikipedia.org/wiki/Eddy_current_brake (Accessed Aug. 14, 2008).
Printout from the Wikipedia web-site located at the URL http://en.wikipedia.org/wiki/Eddy_currents (Accessed Nov. 14, 2007).

(Continued)

*Primary Examiner* — Emmanuel M Marcelo
*Assistant Examiner* — Justin Stefanon
(74) *Attorney, Agent, or Firm* — Caesar, Rivise, Bernstein, Cohen & Pokotilow, Ltd.

(57) ABSTRACT

A single cable descent control device comprises a pair of rotors with corresponding frames of conductive material mounted on a common central axle on either side of a drive pulley. The pulley is adapted to sit above a single descent cable. An enclosure is suspended from the device. Disposed along at least one surface of each of the rotors or of the corresponding frames or both, is a series of magnets such that rotation of the rotors relative to the frames induces eddy currents that oppose the magnetic field and create a rotational braking force providing precise and controllable descent of the enclosure with little or no mechanical wear or risk of overheating. In this configuration, constraints on the size of the enclosure are dispensed with, as are corresponding limitations on the positioning and angle of descent of the cable. Further, significant labor and material savings in manufacturing the enclosure may be obtained from the resulting simplicity of design. The device may be used in numerous other applications, including without limitation, permitting controlled descent of gondolas or chairs from ski lift operations when normal lift operation is temporarily precluded.

23 Claims, 5 Drawing Sheets

(56) References Cited

OTHER PUBLICATIONS

Printout from the Physlink.com web-site located at the URL http://www.physlink.com/Education/AskExperts/ae527.cfrin (Accessed Nov. 14, 2007).
Printout from the Wikipedia web-site located at the URL http://en.wikipedia.org/wiki/lenz%27s_law (Accessed Dec. 10, 2007).
Printout of demonstration of the Eddy Current effect with an aluminum block in an MRI at http://youtube.com/watch?v=fxC-AEC0ROk (Accessed Dec. 10, 2007).
Printout of web-site located at the URL http://www.landspeed.com/researchbraking.html (Accessed Dec. 10, 2007).
Printout of web-site located at the URL http://hyperphysics.phy-astrgsu.edu/hbase/magnetic/elemag.htnnl (Accessed Dec. 10, 2007).

* cited by examiner

SINGLE CABLE DESCENT CONTROL DEVICE

TECHNICAL FIELD

The present disclosure relates to an apparatus for controlling the descent rate of a structure along a cable, and more particularly, to a descent control device for controlling the speed of descent along a single cable from a raised platform to the ground of an enclosure suspended from the cable.

INTRODUCTION

In co-pending and commonly owned Canadian Patent Application No. 2,646,073 filed Dec. 9, 2008 by Hartman et al and entitled DESCENT CONTROL DEVICE, which is incorporated by reference in its entirety herein, a magnetic descent control device is disclosed. The device provides braking capability to an enclosure for rapid but controlled transport of personnel from an elevated structure to a ground surface a distance away from the structure. The descent path of the enclosure is defined by at least one cable extending between an upper point affixed to the structure and a lower point affixed to the ground surface.

The device comprises a central axle affixed to a rotating driven sheave acting as a drive assembly, which grips the cable guiding the descent path of a body carrying cage. The central axle has a shoulder upon which rests a rotor. The rotor is encased within a front and back frame of conductive material. Disposed along at least one surface of the rotor or at least one of the conductors or both, is a series of magnets such that rotation of the rotor relative to the conductors creates relative motion between the magnets' magnetic field and the conductor and induces eddy currents in the conductor that oppose the magnetic field and create a rotational braking force. As a result, precise and controllable descent of the enclosure may be obtained with little or no mechanical wear or risk of overheating.

Each device is mounted on an inner surface of a side wall of the enclosure with the central axle passing through the side wall and being driven by a driven sheave in contact with the cable on the outer surface of the side wall. Hartman et al. disclosed using a plurality of such devices to drive assemblies contacting a common cable and using at least two cables one on either side of the enclosure. The devices on each side of the enclosure are supported by a plurality of adjacent idler sheaves to impart tension to the cable where the driven sheaves engage it. As a result of the foregoing, the minimum size, structure and composition of the side walls of the enclosure are constrained in that they are sufficiently large and rigid to support three or four sheaves thereon.

Since the devices pass through the side wall of the enclosure, which is maintained in a generally vertical orientation for the safe transport of personnel, the steepness of the angle of descent of the enclosure is also somewhat constrained, which imposes limitations on the positioning of the cable both at the elevated structure end and at the ground surface, especially given that at least two cables are used. Moreover, considerable site preparation may be called for to ensure that there remains clearance along the descent path for both the cable and the enclosure.

BRIEF DESCRIPTION OF THE DRAWINGS

Like reference numerals are used in the drawings to denote like elements and features.

DESCRIPTION

The present disclosure provides an example embodiment of a single cable descent control device. Such descent control device comprises a pair of rotors with corresponding frames of conductive material mounted on a common central axle on either side of a drive pulley. The pulley is adapted to sit above a single descent cable. A load is suspended from the device. Disposed along at least one surface of each of the rotors or of the corresponding frames or both, is a series of magnets such that rotation of the rotors relative to the frames induces eddy currents that oppose the magnetic field and create a rotational braking force providing precise and controllable descent of the enclosure with little or no mechanical wear or risk of overheating.

In this configuration, the constraints on the size of the side wall of the load are dispensed with, as are a number of the plurality of idler sheaves and corresponding limitations on the positioning and angle of descent of the cable. Further, significant labor and material savings in manufacturing the enclosure may be obtained from the resulting simplicity of design.

The device may be used in numerous other applications, including without limitation, permitting controlled descent of gondolas or chairs from ski lift operations when normal lift operation is temporarily precluded.

Figure 1:
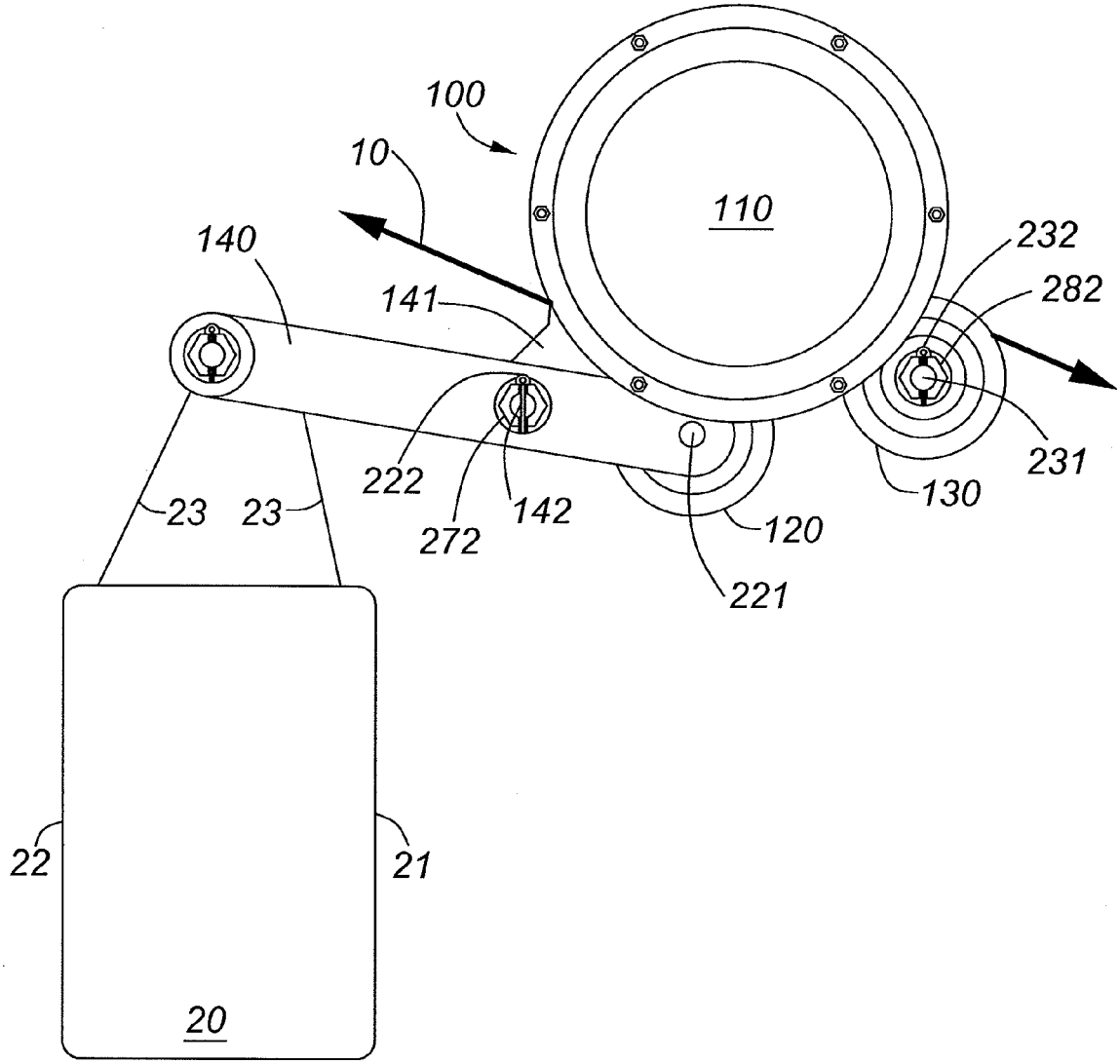
FIG. 1 is a side view of a descent control device in accordance with one example embodiment of the present disclosure.

Reference is now made to FIG. 1, which illustrates a side view of an improved descent control device 100. The descent control device 100 engages a single descending cable 10 having a first end attached to an upper point affixed to an elevated structure (not shown), in some example embodiments by a platform anchor (not shown), and a second end attached to a lower surface a distance away from the structure, which in some embodiments may be or may be affixed to a ground surface (not shown), in some example embodiments by a terminal anchor (not shown). In some example embodiments, the second end may be horizontally distanced between about 15 to more than 200 feet away from the structure. In some example embodiments, the cable 10 may be a ½" diameter steel cable.

The descent control device 100 supports a load 20 suspended below it and provides a gentle descent path defined by the cable 10 for the load 20 from the structure to the ground surface when descent of the load 20 is triggered. In some example embodiments, the descent control device 100 may be used to transport personnel or equipment or both from the raised structure to the ground surface in a controlled and safe fashion. In some example embodiments, the load 20 may be a safety pod engaging an opening in a working platform of an oil derrick and descent may be triggered manually or automatically when personnel board or engage the pod such as in an emergency situation. In some example embodiments, the load 20 may be a chair or a gondola in a ski lift and descent may be triggered remotely by a ski lift operator, for example when the lift is stopped. In some example embodiments, the load 20 may be a safety or fall restraint harness that may be worn by and support one or more persons.

For purposes of clarity of description only, the end of the enclosure that faces in the direction of the downwardly extending cable 10 (in FIG. 1, to the right) is referred to as the front end 21 of the load 20, so that in some example embodiments, personnel and equipment may embark and disembark from the rear end 22 of the load 20. Similar references to front and back will be applied in describing the descent control device 100.

The descent control device 100 comprises a brake assembly 110, a pinch roller 120 and an idler pulley 130. In some example embodiments, the brake assembly 110 is disposed toward the rear of the device 100 and the idler pulley 130 is disposed toward the front of the device 100. The pinch roller 120 pinches the cable 10 against the brake assembly 110 to facilitate a traction grip between the brake assembly 110 and the cable 10. The idler pulley 130 serves to raise the cable 10 relative to the brake assembly 110 at its front end to facilitate a traction grip between the brake assembly 110 and the cable 10. The cable 10 is looped under the brake assembly 110 (as may be better seen in FIG. 2) and pinched between it and the pinch roller 120 and over the top of the idler pulley 130. The pinch roller 120 and the idler pulley 130 primarily aid in maintaining tension in the cable 10 as it passes under and is engaged by the brake assembly 110.

A davit arm 140 extends rearwardly from the pinch roller 120, supported by a davit arm mounting bracket 141 extending rearwardly from the brake assembly 110 to a central point 142 on the davit arm 140. The davit arm 140 is rotationally connected to the central point 142 and held in place, in one example embodiment, by a nut 272 and pin 222. A rearmost end of the davit arm 140 is configured to support the load 20, such as by one or more suspended cables 23. The davit arm 140 also provides support to the pinch roller 120. The idler pulley 130 is supported by a mounting bracket (not shown) extending from the brake assembly 110.

Figure 2:
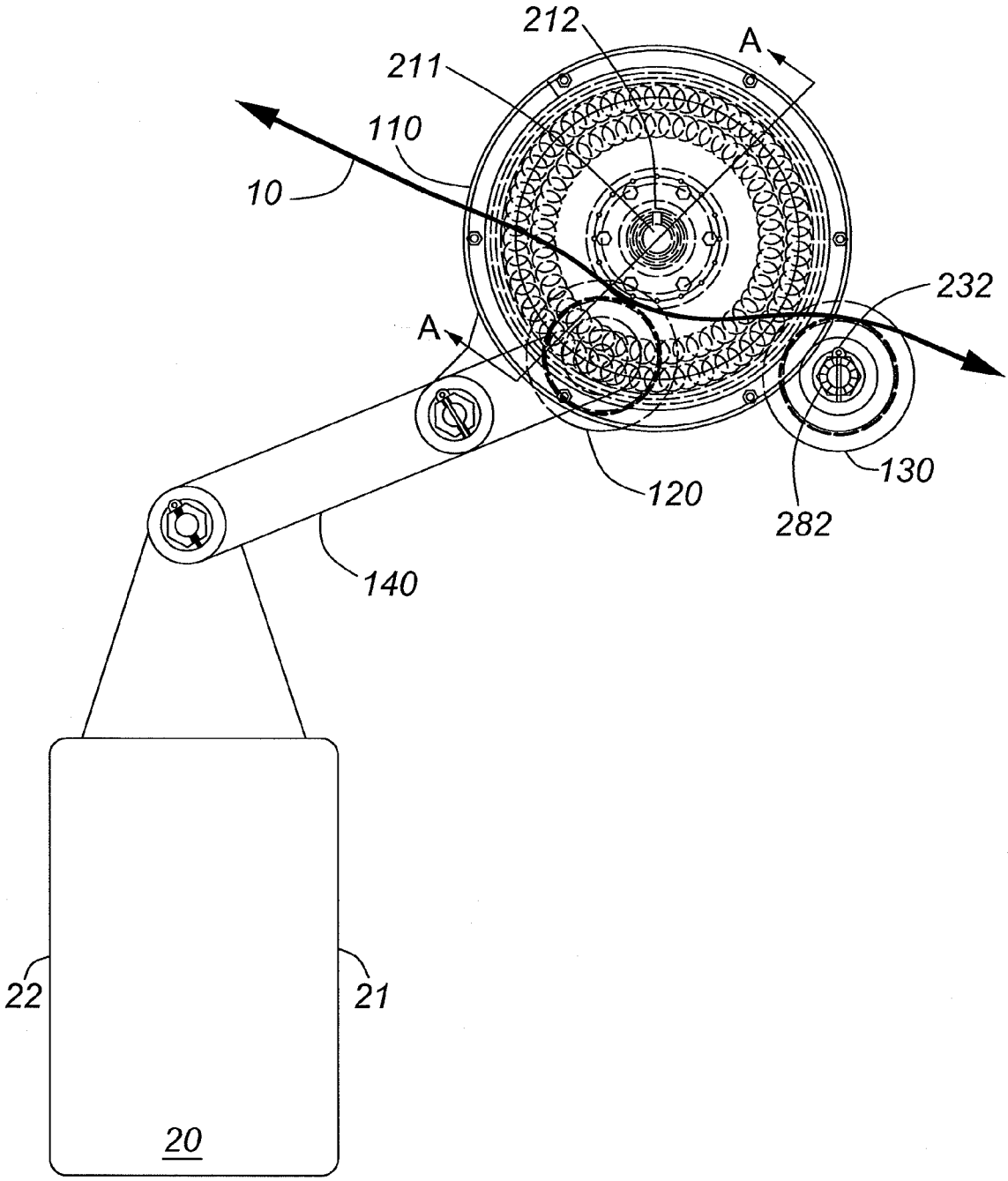
FIG. 2 is a side view, partially in cross-section, of the descent control device of the example embodiment of FIG. 1.

FIG. 2 is a side view, partially in cross-section, of the descent control device 100. The path of the cable 10 is looped under the brake assembly 110 and pinched between it and the pinch roller 120 before passing over the idler pulley 130. The suspended load 20 causes the brake assembly 110 to impart downward traction on the cable 10. The braking assembly 110 has a central axle 211 about which portions of the brake assembly 110 rotate freely, while the pinch roller 120 and the downstream pulley 130 each have a corresponding parallel axle 221, 231.

Figure 3:
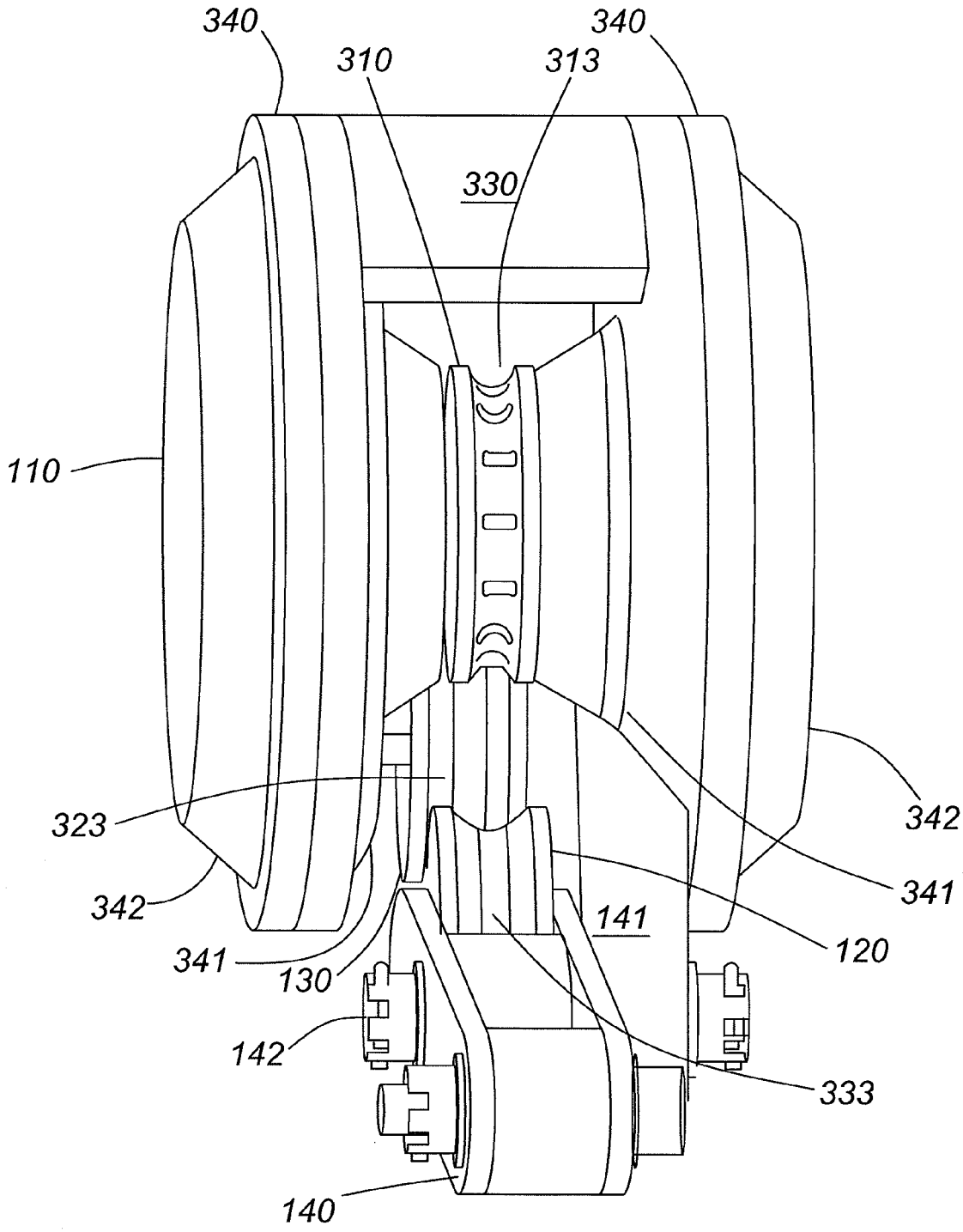
FIG. 3 is a rear elevation view of the descent control device of the example embodiment of FIG. 1, with the cable removed.

FIG. 3 is a rear elevation view of the descent control device 100, with the cable 10 removed for clarity. The brake assembly 110 comprises a drive pulley 310 that is rotatable about the central axle 211 and is aligned with the supporting pulley 120 and the idler pulley 130. The drive pulley 310 traverses, engages and cradles the cable 10 and rotates (clockwise in the configuration shown in FIG. 2) as it descends along the path defined by the cable 10 and causes the central axle 211 of the drive pulley 310 to rotate correspondingly.

Key 212 interconnects the central axle 211 with the drive pulley 310, so that the central axle 211 is in fixed rotational engagement with the drive pulley 310. Pinch roller 120 and idler pulley 130 are each free to rotate about their corresponding axles 221, 231. In one example embodiment, the idler pulley 130, is held in place by a nut 282 and a pin 232.

The central axle 211 extends out outwardly on either side of the drive pulley 310.

The drive pulley 310 is positioned between a pair of conductive frames 340 each defining an enclosed cavity region. In some example embodiments, the drive pulley 310 is centered equidistant between the frames 340 and held in place on the central axle 211 by a pair of snap rings 401, one on either side of the drive pulley 310.

Figure 4:
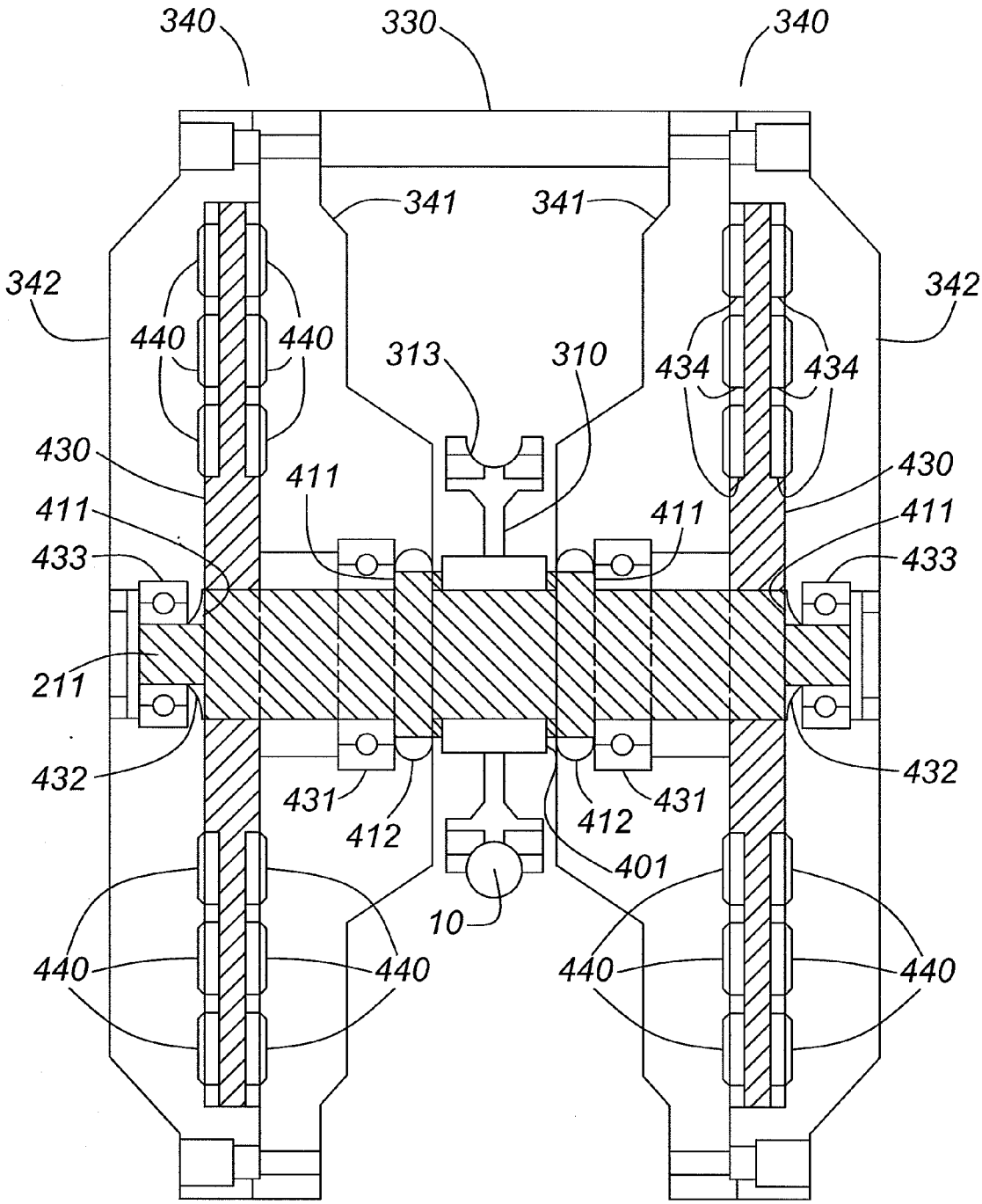
FIG. 4 is an enlarged rear cross-sectional view, taken along section A-A in FIG. 2, of the central brake assembly of the descent control device of the example embodiment of FIG. 1.

Each frame 340 is comprised of frame elements such as a flange plate 341 having a central bore (not shown) through which the central axle 211 may pass and a back plate 342 adapted to engage the flange plate 341. In some example embodiments, the flange plate 341 and back plate 342 are connected together at points radially distal from the corresponding enclosed rotor 430 (FIG. 4). Each frame 340 may also include a double lip seal installed in the flange plate 341 to keep contaminants out of the brake assembly 110. In some example embodiments, a cover member 330 interconnects the top and front portions of the flange plates 341 to separate the two frames 340 and protect the drive pulley 310 against accumulation of snow, ice, grease, dirt, wax or the like between the frames 340. A lug (not shown) may be attached to the cover member 330 to assist in transporting the device 100 or hoisting it into position on the cable 10.

In some example embodiments, the cover member 330 terminates at a point above the central axle 211 of drive pulley 310 at the rear end of the device 100, allowing the pinch roller 120, idler pulley 130 and davit arm 140 to rotate upward as it supports the load 20, without interfering with the cable 10.

In some example embodiments, the flange plates 341 on at least one side may be cut away at the bottom to facilitate mounting of the davit arm mounting bracket 141 and consequently the davit arm 140, the load 20 and the pinch roller 120 to the device 100.

In some example embodiments, a channel 313, which may be semi-circular in shape, is formed into the circumferential end surface of the drive pulley 310. The channel 313 guides and increases traction of the cable 10. In one example embodiment, the channel 313 is slotted to a specific size and spacing to accept the cable 10 therearound in a traction fit and also acts to displace any debris that may have built up on the cable 10 such as snow, ice, grease, dirt, wax or the like. In some example embodiments, similar channels 323, 333 may be formed in the pinch roller 120 or the idler pulley 130 or both.

As may be seen from FIG. 4, which shows a cross sectional view from the rear of the brake assembly 110, in some example embodiments, the central axle 211 has one or more pairs of shoulders 411 that surround and define a central portion of the central axle 211 around which the diameter of the central axle 211 changes. They are disposed on either side of the drive pulley 310. In some example embodiments, the central axle 211 has a larger dimension in the central region between the shoulders 411 where the central axle 211 passes through the drive pulley 310. In some example embodiments, there are two sets of shoulders 411, one nested inside the other, each surrounding the drive pulley 310. In some example embodiments, seals 412 are positioned over the larger dimension of the central axle 211 between the drive pulley 310 and its closest shoulder 411.

The cavity region defined by each frame 340 accommodates a moving element such as a substantially planar rotor 430 having a central bore to accept and be rotationally driven by the central axle 211 in fixed rotational engagement with the central axle 211 and in a plane normal to the axis of the central axle 211, within and without touching the frame 340 on either side of the drive pulley 310. One side of each rotor 430 abuts the corresponding shoulder 411 such that a smaller dimension of the central axle 211 passes through each rotor 430 so as to maintain a minimum spacing between each rotor 430 and the corresponding flange plate 341.

Each rotor 430 is a cylindrical disk with a central bore 500 (FIG. 5) to accommodate the central axle 211. Each rotor 430 is proximate to and spaced apart from its corresponding flange plate 341 by a flange bushing or bearing 431 having a central bore to accommodate the central axle 211 and is proximate to and spaced apart from its corresponding back plate 342 by a spacer 432 or a back bushing or bearing 433 or both, which also have a central bore to accommodate the central axle 211. The flange bushings 431 or the spacers 432 or both may be positioned against the shoulder 411 to maintain alignment of each rotor 430 parallel to the central pulley 310. In some example embodiments, the central axle 211 rotationally engages the flange bearings 431 and back bearings 433.

In some example embodiments, the surface of one or more rotors 430 are spaced 0.040" from the corresponding flange plate 341 on one side and the same distance from the corresponding back plate 342 on the other side.

Each rotor 430 includes, in some example embodiments, a plurality of recesses 434, which in some example embodiments may be present on each side of the rotor 430 in an identical pattern. Each recess 434 receives a magnet 440 having axial magnetization. The magnets 440 are mounted in a parallel magnetic pole orientation in such a configuration that forms several distinct regions of polarity on the rotor 430. In some example embodiments, the configuration is such that the main flux exiting the rotor 430 is of a common polarity.

Each recess 434 may be, in some example embodiments, ¾" in diameter and ⅛" deep to receive a Neobdymium rare earth or other fixed magnet 440. In some example embodiments, the magnets 440 may be electromagnets. In some example embodiments, the recesses 434 may be arranged in several concentric rings about the central axle 211. In some example embodiments, the recesses 434 may pass entirely through the rotor 430 and the magnets 440 mounted so as to extend partly through the rotor 430.

In some example embodiments, the magnets 440 may be composed of NdFeB N42 material, have an 0.750" diameter and a 0.125" thickness and a magnetic field strength of 13,200 Gauss/3,240 surface field Gauss. In some example embodiments, the total number of magnets 440 disposed on each side of the rotor 430 may be 48.

In some example embodiments, the rotor 430 is composed of ferromagnetic steel. Alternatively, one or more of the rotors 430 may be composed of aluminum, copper, laminated steel and copper or plastic, especially if the frames 340 house the magnets 440, rather than the rotors 430.

In some example embodiments, the rotor 430 may be comprised of a magnetic material having a corresponding magnetic pole orientation normal to the plane of the rotor 430 and thus obviating the use of recesses 434 and discrete magnets 440 for mounting in the recesses 434.

In some example embodiments, the rotor 430 acts merely as a conductor and the surrounding frame 340 is magnetized, between which the rotor 430 rotates as the drive pulley 310 is rotated. In such example embodiments, the materials out of which the rotor 430 and the frame 340 are composed may be reversed.

The conductive frame 340 comprising the flange plate 341 and the back plate 342 surrounds the planar faces of the corresponding rotor 430 but permits such rotor 430 to rotate freely relative to the walls of the frame 340, which are substantially parallel to the plane of the rotor 430. The rotation of the rotor 430 relative to the frame 340 induces eddy currents in the frame 340.

Each flange plate 341 is formed of a conductive metal, which in some example embodiments may be 6061-T6 aluminum, or steel, especially if the frame 340 houses the magnets 440 rather than the rotors 430, and is disposed between the rotor 430 and the drive pulley 310. In some example embodiments, the flange plate 341 may be cladded or inserted with a material such as copper so as to alter the patterns or intensity or both of the eddy currents induced therein.

The flange plate 341 may be held in place by the flange bushing or bearing 431 which secures the axial position of the flange plate 341 relative to the central axle 211 but permits rotational movement of the central axle 211 relative to the flange plate 341.

Each flange bearing 431 surrounds the central axle 211 to hold the corresponding flange plate 341 in place axially while permitting rotation of the central axle 211. The flange bearing 431 may be a ball bearing, bushing, spacer, sleeve, coupling or other such element. In some example embodiments, one or more of the flange bearings 431 is a ball bearing.

The back plate 342 is formed of a conductive metal, which in some example embodiments may be 6061-T6 aluminum, or steel, especially if the frame 340 houses the magnets 440 rather than the rotors 430, in a shape to enclose the corresponding end of the central axle 211 and the side of the corresponding rotor 430 not otherwise enclosed by the corresponding flange plate 341. In some example embodiments, the back plate 342 may be cladded or inserted with a material such as copper so as to alter the pattern or intensity or both of the eddy currents induced therein.

The back plate 342 may be held in place by the back bushing or bearing 433, which secures the axial position of the back plate 342 relative to the central axle 211 but permits rotational movement of the central axle 211 relative to the back plate 342.

Each back bearing 433 surrounds the central axle 211 to hold the corresponding back plate 342 in place axially while permitting rotation of the central axle 211. The back bearing 433 may be a ball bearing, bushing, spacer, sleeve, coupling or other such element. In some example embodiments, one or more of the back bearings 433 is a ball bearing.

Each spacer 432 surrounds and abuts the central axle 211 and abuts the other side of the rotor 430 opposite the corresponding shoulder 411 by contacting an inner race of a corresponding back bearing 433. The spacers 432 hold the rotors 430 securely in place against the shoulders 411 of the central axle 211 to maintain a space between the backing plate 342 and the corresponding rotor 430.

To further assist in the removal of snow, ice, grease, dirt, wax or the like, and to increase heat dissipation when the cable 10 moves through the channel 313, the drive pulley 310 may in some example embodiments include a series of channel bores (not shown) extending parallel to the axis of rotation near the circumferential end surface of the drive pulley 310. In some example embodiments, similar channel bores (not shown) may be formed in like manner in the pinch roller 120, or the idler pulley 130 or both.

Figure 5:
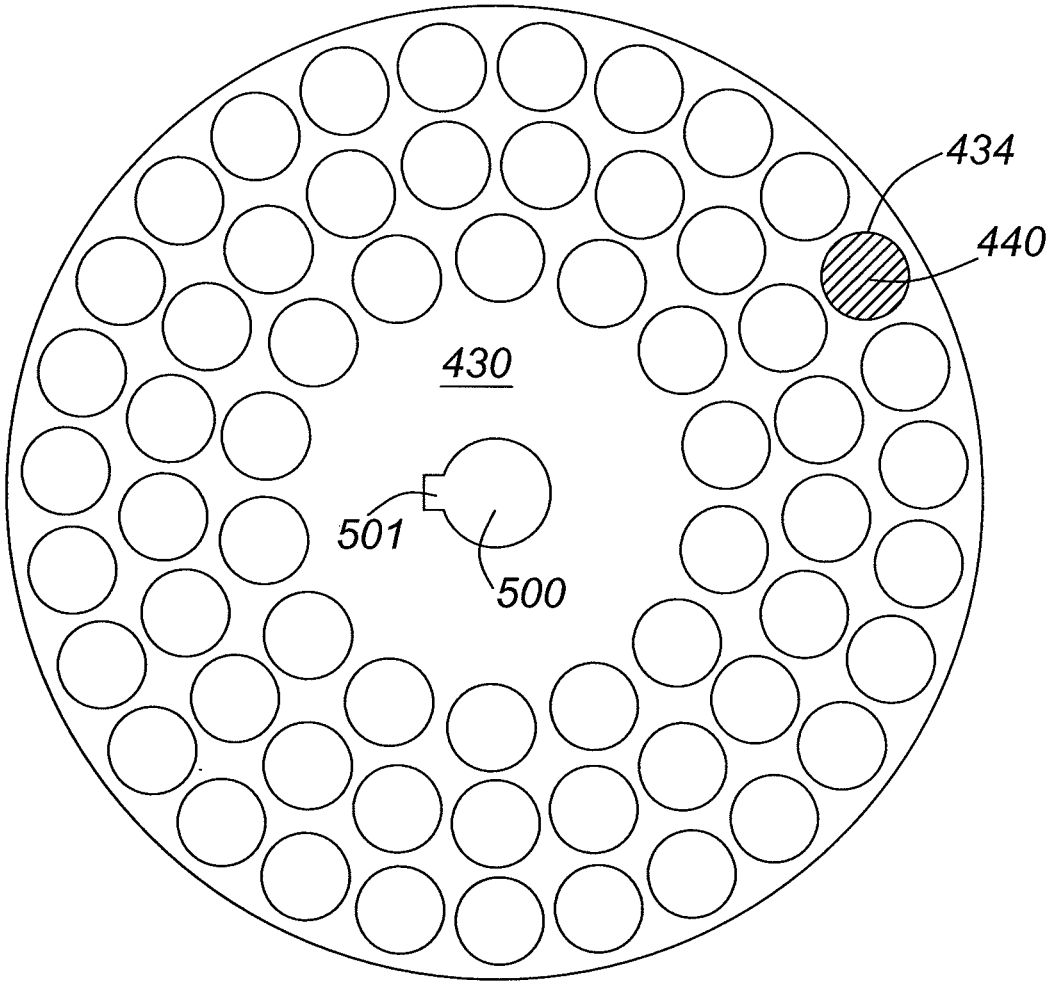
FIG. 5 is a plan view of an example embodiment of a rotor for use in the descent control device of the example embodiment of FIG. 1.

Turning now to FIG. 5, an example embodiment of a rotor 430 suitable for use in the descent control device 100 is described. The rotor 430 includes three rings of recesses 434, each recess 434 being adapted to accept a magnet 440. At the centre of the rotor 430, a key 501 is cut out of the rotor 430 to receive a portion of the shoulder 411 of the central axle 211 in such a manner to maintain the rotor 430 in rotated engagement with central axle 211.

In operation, the descent control device 100 with suspended load 20 is released to descend along the path defined by cable 10. Descent of the device 100 along cable 10 under load imparts traction between the drive pulley 310 and the cable 10 which causes rotation of the central drive pulley 310, which causes rotation of the central axle 211. Rotation of the central axle 211 causes rotation of both rotors 430 and the magnets 440 mounted thereon, such as in recesses 434. Rotation of the magnets 440 causes the magnetic field created by the axial polarity of the magnets 440 to rotate.

The rotational movement of the magnetic field of each rotor 430 relative to the frame 340 induces eddy currents in the frame 340 in a pattern that mirrors that of the magnetic field created by the magnets 440. Because the eddy currents and the magnetic field mirror each other, they interact to oppose the rotation of the magnetic field. This opposition to rotation of the magnetic field translates to a braking force against the rotation of the magnets 440 in the rotors 430, against the rotation of the central axle 211 and against the rotation of the central drive pulley 310, slowing the descent of the descent control device 100 and suspended load 20 along the cable 10. Consequently, the device 100 and suspended load 20 make their descent along the path defined by the cable 10 at a controlled rate.

The descent control device 100 operates passively in braking the cable 10 in that there is no applied power or control to operate it. Rather, the rotation of each rotor 430 creates a traveling wave magnetic field relative to the conductive frame 340. During rotation, the traveling wave magnetic field is in motion relative to a conducting medium such as the frame 340. The relative motion of this wave induces eddy currents in the conductive medium in a pattern which mirrors that of the driving field. The induced eddy currents interact with the field of the magnets 440 to develop a braking force. As long as the magnets 440 remain magnetized and relative motion is developed between the magnets 440 and the frame 340, a braking force is generated. The braking force is a function of the relative strengths of one or more of the magnets 440, and induced currents and their relative phase offsets. The magnitude and phase offset of the induced current may vary as a function of the relative wave velocity, magnetic field strengths, wavelength of the field and conductor resistivity.

The strength of the braking force may be proportional to the distance between the rotors 430 and the frame 340 and the thickness of the frame 340. The braking force may be controlled by adding or removing magnets 440, changing the spacing between the flange plate 341 and rotor 430, changing the spacing between the back plate 342 and rotor 430, changing the diameter of the flange plate 341, back plate 342 or rotor 430 or any combination of them, changing the type or strength of the magnets 440; changing the material from which the back plate 342, flange plate 341, rotors 430, magnets 440 or any combination of them are composed or with which they are cladded or inserted, or changing the number of rotor 430 and frame 340 pairs on the central axle 211. In some experiments, machining the flange plate 341 and back plate 342 to include a 3/16" copper plate resulted in an increase in braking power of at least around 40%.

Because the strength of the eddy currents may be proportional to the velocity of the rotors 430 relative to the stationary frames 340, as the rate of descent of the device 100 increases, the braking force increases. Similarly, decreasing the rate of the device 100 decreases the braking force. This proportionality produces a relatively smoother deceleration and allows the device 100 to descend in a controlled manner towards the terminal location (not shown), resulting in a relatively gentler landing. Rates of descent of about 14 ft/s (peak at around 22 ft/s) have been experienced for descents from high elevations, while more moderate descent elevations result in rates of descent of about 7-8 ft/s and landing speeds as low as 2 ft/s.

In simulation testing, a first-order analysis assumed a single pure sinusoid traveling magnetic wave due to field rotation. The simulation assumed a pole gap field amplitude of 3240 Gauss, frame 340 resistivity of $4\times10^{-8}$ ohm-m (aluminum), approximate gap field wavelength of 25 mm, drive pulley 310 diameter of 4.0", effective rotor 430 drag area of 61 square inches, total weight (of device 100 and suspended load 20 (including contents)) of 600 lbs and descent by gravity at a 45° angle. The braking force decreased when descent speed exceeded 28 ft/s. At a descent speed of 12 ft/s, the drag force on the device 100 and suspended load 20 was approximately 180 lbs. However, this data should be treated as an estimate and approximate only.

In fact, the magnetic field created may be significantly more complex than a single pure sinusoid traveling magnetic wave, with higher order terms that will result in multiple traveling waves of different amplitudes and lengths. Each traveling wave may produce a characteristic drag/speed curve. The total drag may be the Fourier sum of the force contributed by each of these traveling waves. The higher order wave components due to edge effects tend to substantially increase the total braking force. As such, the total braking force may be in the range of 50% to 100% greater than that predicted by the single-wave analysis.

The use of a pair of rotors 430 disposed on either side of the drive pulley 310 has a number of beneficial effects. First, a single drive pulley 310 may be employed, eliminating any additional cables 10. The multiple rotors 430 may provide a similar level of braking force as two rotor/pulley combinations, such as the pair of rotor/pulley combinations disposed on either side of the enclosure described in Canadian Patent Application No. 2,646,073 described above. In some example embodiments, if additional braking force is appropriate, more than one rotor 430 may be disposed on the central axle on either side of the drive pulley 310. In some example embodiments, an odd number of rotors 430 are used, so that there are more rotors 430 on one side of the drive pulley 310 than the other. In some example embodiments, weight distribution may be achieved by adding weight to the side of the central axle 211 that has fewer rotors 430, including rotor 430/frame 340 pairs without magnets in the rotor 430.

Second, the single cable 10 configuration permits the cable 10 to take steeper descent paths or descent paths through narrower openings between obstacles.

Third, the descent control device 100 disclosed in the present disclosure provides greater freedom in positioning the device 100 relative to the load 20 and the cable 10. In particular, with a single cable 10 configuration, the load 20 may be suspended from the device 100 instead of the device being affixed to each side of the load 20. This provides additional flexibility in terms of the load configuration, which may vary from a fall restraint harness to a safety pod to a ski lift chair or gondola. Further, because the descent control device 100 extends above and supports the load 20 instead of the load 20 supporting the device 100 on opposing walls, considerable weight and materials savings may be achieved. For example, in comparison to Canadian Patent Application No. 2,646,073 described above, the number of cables 10 is reduced from two to one, the number of drive pulleys 310 is reduced from four (two per cable) to one, the number of supporting pulleys, namely pinch rollers 120 and idler pulleys 130 is reduced from four (two per cable) to two (two per cable), and the side walls of the enclosure acting as a load 20 may be dispensed with.

Fourth, the descent control device 100 is easier to configure, transport, install and store away.

While the present disclosure is sometimes described in terms of methods, the present disclosure may be understood to be also directed to various apparata including components for performing at least some of the aspects and features of the described methods, be it by way of hardware components or combinations thereof, or in any other manner. Such apparata and articles of manufacture also come within the scope of the present disclosure.

The various embodiments presented herein are merely examples and are in no way meant to limit the scope of this disclosure. Variations of the innovations described herein will become apparent from consideration of this disclosure and such variations are within the intended scope of the present disclosure.

For example, the magnets 440 could be mounted in the flange plate 341 or the back plate 342 or both and the eddy currents could be formed in the rotor 430.

By way of further example, a conventional ski lift could be configured with the disclosed descent control device 100 imposed between the lift chair or gondola as load 20 and the cable 10, and to allow the portion of each lift chair or gondola 20 that conventionally grips the cable 10 to be remotely and selectively released from the cable 10 in the event of an emergency or malfunction, allowing each lift chair or gondola 20 to descend in controlled fashion to discharge passengers serially.

In particular, features from one or more of the above-described embodiments may be selected to create alternative embodiments comprised of a sub-combination of features which may not be explicitly described above. In addition, features from one or more of the above-described embodiments may be selected and combined to create alternative embodiments comprised of a combination of features which may not be explicitly described above. Features suitable for such combinations and sub-combination will become readily apparent upon review of the present disclosure as a whole. The subject matter described herein and in the recited claims intends to cover and embrace all suitable changes in the technology.

In accordance with a first broad aspect of an embodiment of the present disclosure, there is provided a descent control device for controlling movement of a load along a path defined by a cable extending from an initial high point to a terminal low point. A drive pulley rotatable about an axis engages and traverses the cable. An axle in fixed rotational engagement with the pulley extends on either side of the pulley along the axis. At least one substantially planar moving element is positioned on each side of the pulley in fixed rotational engagement with the axle. At least one conducting frame element is disposed proximate to each moving element such that an eddy current may be induced by rotational movement of each moving element relative to the corresponding at least one frame element in a direction to oppose acceleration of the pulley as it rotationally engages the cable.

Other embodiments consistent with the present disclosure will become apparent from consideration of this specification and the practice of the disclosure set out therein.

Accordingly the specification and the embodiments disclosed therein are to be considered examples only, with a true scope and spirit of the disclosure being disclosed by the following numbered claims:

What is claimed is:

1. A descent control device for controlling movement of a load along a path defined by a cable extending from an initial high point to a terminal low point, the device comprising:

(a) drive pulley rotatable about an axis for engaging and traversing the cable;

(b) an axle in fixed rotational engagement with the pulley and extending on either side thereof along the axis;

(c) at least one substantially planar ferromagnetic moving element positioned on each side of the pulley in fixed rotational engagement with the axle, the at least one moving element comprising at least one recess formed in a surface thereof, and at least one magnet fixedly disposed within the recess; and (d) at least one conducting frame element disposed proximate to each moving element whereby an eddy current is induced by rotational movement of each moving element relative to the corresponding at least one frame element in a direction to oppose acceleration of the pulley as the pulley rotationally engages the cable.

2. The descent control device according to claim 1, wherein the drive pulley is centered along the axle.

3. The descent control device according to claim 1, the axle comprising at least one shoulder on each side of the drive pulley.

4. The descent control device according to claim 1, wherein the at least one moving element is maintained parallel with the drive pulley.

5. The descent control device according to claim 1, wherein the moving element is maintained perpendicular to the central axle.

6. The descent control device according to claim 1, wherein the drive pulley is centered between the at least one moving element on either side thereof.

7. The descent control device according to claim 1, wherein a single moving element is positioned on either side of the pulley.

8. The descent control device according to claim 1, further comprising a pinch roller for pinching the cable against the circumferential end surface of the drive pulley.

9. The descent control device according to claim 8, wherein a circumferential end surface of the pinch roller comprises a channel sized to accept the cable in a friction fit.

10. The descent control device according to claim 8, wherein the pinch roller is supported on a bracket extending from one of the at least one frame element.

11. The descent control device according to claim 8, further comprising a davit arm extending away from the pinch roller.

12. The descent control device according to claim 11, wherein the davit arm extends toward the initial high point of the path.

13. The descent control device according to claim 11, the davit arm for supporting a load suspended from a distal end thereof.

14. The descent control device according to claim 1, further comprising an idler pulley toward the terminal low point of the path for raising the cable relative to the drive pulley.

15. The descent control device according to claim 14, wherein a circumferential end surface of the idler pulley comprises a channel sized to accept the cable in a friction fit.

16. The descent control device according to claim 1, wherein the at least one magnet is disposed such that it is facing one of the corresponding at least one frame element.

17. The descent control device according to claim 1, wherein a first one of the at least one magnet is disposed at a point on a first face of the at least one moving element having an outwardly facing first polarity and a second one of the at least one magnet is disposed at a corresponding point on a second face of the at least one moving element having an outwardly facing second polarity opposite to the first polarity.

18. The descent control device according to claim 1, wherein the at least one magnet is a rare earth magnet.

19. The descent control device according to claim 1, wherein a magnetic field is induced in a direction transverse to a direction of movement of each of the at least one moving element.

20. The descent control device according to claim 1, wherein the at least one moving element is a rotor.

21. The descent control device according to claim 1, wherein the at least one frame elements comprise first and second frame portions surrounding the corresponding at least one moving element.

22. The descent control device according to claim 1, wherein a circumferential end surface of the pulley comprises a channel sized to accept the cable in a friction fit.

23. The descent control device according to claim 1, further comprising a cover extending above the pulley from one of the at least one frame element on a first side of the pulley to one of the at least one frame element on a second side of the pulley.

* * * * *